US010473375B2

(12) United States Patent
Garside et al.

(10) Patent No.: US 10,473,375 B2
(45) Date of Patent: Nov. 12, 2019

(54) APPARATUS AND METHOD FOR CONTROLLING A CRYOGENIC COOLING SYSTEM

(71) Applicant: Oxford Instruments Nanotechnology Tools Limited, Oxfordshire (GB)

(72) Inventors: John Garside, Witney (GB); Matthias Buehler, Abingdon (GB); Daniels Tortorella, Abingdon (GB); Xing Yuan, Abingdon (GB)

(73) Assignee: Oxford Instruments Nanotechnology Tools Limited, Oxfordshire (GB)

( * ) Notice: Subject to any disclaimer, the term of this patent is extended or adjusted under 35 U.S.C. 154(b) by 1260 days.

(21) Appl. No.: 14/347,881

(22) PCT Filed: Sep. 27, 2012

(86) PCT No.: PCT/GB2012/052395
§ 371 (c)(1),
(2) Date: Mar. 27, 2014

(87) PCT Pub. No.: WO2013/045929
PCT Pub. Date: Apr. 4, 2013

(65) Prior Publication Data

US 2014/0245757 A1 Sep. 4, 2014

(30) Foreign Application Priority Data

Sep. 27, 2011 (GB) ..... 1116639.4

(51) Int. Cl.
*F25B 49/00* (2006.01)
*F25B 9/14* (2006.01)

(52) U.S. Cl.
CPC ..... *F25B 49/00* (2013.01); *F25B 9/14* (2013.01); *F25B 2309/006* (2013.01);
(Continued)

(58) Field of Classification Search
CPC .... F25B 49/00; F25B 9/014; F25B 2309/006; F25B 2309/1427; F25B 2700/19;
(Continued)

(56) References Cited

U.S. PATENT DOCUMENTS 4,825,660 A * 5/1989 Okumura ..... F25B 9/14 62/228.3
5,398,512 A * 3/1995 Inaguchi ..... F25B 9/14 62/6

(Continued)

FOREIGN PATENT DOCUMENTS

JP S60171359 A 9/1985
JP H062972 A 1/1994

(Continued)

*Primary Examiner* — Christopher R Zerphey
*Assistant Examiner* — Steve S Tanenbaum
(74) *Attorney, Agent, or Firm* — Blank Rome LLP

(57) ABSTRACT

Apparatus for controlling a cryogenic cooling system is described. A supply gas line (3A) and a return gas line (3B) are provided which are coupled to a compressor (1) and to a mechanical refrigerator (2) via a coupling element (4). The coupling element is in gaseous communication with the supply (2A) and return gas lines and supplies gas to the mechanical refrigerator (2). The pressure of the supplied gas is modulated by the coupling element in a cyclical manner. A pressure sensing apparatus (6) monitors the pressure in at least one of the supply and return gas lines. A control system (5) is used to modulate the frequency of the cyclical gas pressure supplied by the coupling element in accordance with the pressure monitored by the pressure sensing apparatus. An associated method of controlling such a system is also described.

12 Claims, 2 Drawing Sheets

(52) U.S. Cl.
CPC ..... *F25B 2309/1427* (2013.01); *F25B 2309/1428* (2013.01); *F25B 2600/25* (2013.01); *F25B 2700/19* (2013.01)

(58) Field of Classification Search
CPC ..... F25B 2600/25; F25B 2309/1428; F25B 9/145; F25B 9/14; F25B 2309/1418; F25B 2309/14181
USPC ..... 62/628, 608, 657, 55.5, 6
See application file for complete search history.

(56) References Cited

U.S. PATENT DOCUMENTS 6,393,845 B1 * 5/2002 Nogawa ..... F25B 9/145 62/6
6,560,969 B1 * 5/2003 Eckels ..... F25B 9/145 62/6
2005/0210889 A1 * 9/2005 Arman ..... F25B 9/145 62/6
2006/0101836 A1 * 5/2006 Tanaka ..... F04B 37/08 62/228.1
2009/0282842 A1 * 11/2009 Koyama ..... F04B 37/08 62/56
2010/0186427 A1 * 7/2010 Okada ..... F04B 37/08 62/55.5
2011/0016890 A1 * 1/2011 Kimura ..... F04B 37/08 62/55.5
2011/0162959 A1 * 7/2011 Okada ..... F04B 37/08 204/192.1

FOREIGN PATENT DOCUMENTS

JP H06300377 A 10/1994
JP H09229503 A 9/1997
JP H09303897 A 11/1997
JP 2002039639 A 2/2002
WO WO 2011095455 A1 * 8/2011 ..... F16K 11/074

* cited by examiner

APPARATUS AND METHOD FOR CONTROLLING A CRYOGENIC COOLING SYSTEM

REFERENCE TO RELATED APPLICATION

The present application is a National Stage of International Patent Application No. PCT/GB2012/052395, filed Sep. 27, 2012, which claims the benefit of GB Application No. 1116639.4 filed Sep. 27, 2011, whose disclosures are hereby incorporated by reference in their entirety into the present disclosure.

FIELD OF THE INVENTION

The present invention relates to an apparatus and method for controlling a cryogenic cooling system, particularly one in which certain types of gas compressor are used to drive mechanical refrigerators.

BACKGROUND TO THE INVENTION

Low temperature properties such as superconductivity and superfluidity are now widely used in a range of different applications including Magnetic Resonance Imaging (MRI), superconducting magnets, sensors and in fundamental research. Historically, the evaporation of cryogenic liquids such as nitrogen or helium has been used as a cooling mechanism in order to reach the low temperatures required for such applications. Cryogenic liquids have associated disadvantages in that they are often "consumable" due to leaks within associated apparatus such as "in situ" liquefiers or storage vessels. Furthermore such apparatus for storing or otherwise handling cryogenic liquids is often bulky and requires special handling procedures.

More recently, closed cycle refrigerators (CCR) have been used to replace cryogenic liquids in providing an alternative refrigeration mechanism. In contrast with the evaporation of cryogenic liquids, CCRs do not rely upon a phase change within the coolant. Indeed, CCRs operate upon a principle of using the cooling which is associated with the work of compression and expansion of a working gas coolant. The term "mechanical refrigerators" is used herein to describe such apparatus although those of ordinary skill in the art will appreciate that the term "cryocooler" is synonymous with this term.

Mechanical refrigerators use a working gas such as helium to provide cooling at relatively modest cooling powers, to a temperature of 2 to 3 Kelvin. Mechanical refrigerators are extremely advantageous since they are closed systems with few moving parts and are essentially lossless with regard to the working gas. For these reasons, they are attractive both technologically and commercially and there is an ongoing desire to improve the performance of such mechanical refrigerators.

Despite advances which have been made to date in the technology associated with mechanical refrigerators, the thermodynamic coefficient of performance (COP) and the associated cooling efficiency of such mechanical refrigerators are still rather unsatisfactory. As an example, an input electrical power of several kiloWatts is needed in order to provide a cooling power of around 1 Watt at the liquid helium temperature of 4 Kelvin. There are numerous applications, such as the cooling of superconducting magnets or the cooling of relatively high thermal masses, where the cooling time required to cool from room temperature to the low temperature regime is an important parameter. It will be appreciated that it is desirable to reduce this cooling time to as short a period as possible. It is in this context that the present invention finds application and provides new advantages.

SUMMARY OF THE INVENTION

In accordance with a first aspect of the present invention we provide an apparatus for controlling a cryogenic cooling system, comprising a supply gas line and a return gas line adapted to be coupled to a compressor when in use; a pressure sensing apparatus adapted to monitor the pressure in at least one of the supply and return gas lines; a coupling element in gaseous communication with the supply and return gas lines, the coupling element being adapted in use to supply gas to a mechanical refrigerator, the pressure of said supplied gas being modulated by the coupling element in a cyclical manner; and, a control system adapted to modulate the frequency of the cyclical gas pressure supplied by the coupling element in accordance with the pressure monitored by the pressure sensing apparatus.

We have realised that it is possible to improve the cooling efficiency of the mechanical refrigerator by careful control of the frequency of the cyclical gas pressure which is used to operate the mechanical refrigerator. We have also realised that the pressure in one or each of the supply or return gas lines when connected to an operational compressor can be used to provide feedback upon the operational status of the mechanical refrigerator which changes as such a refrigerator undergoes a cooling cycle. With knowledge of how the pressure response of the mechanical refrigerator provides information about the stage of the cooling cycle (for example the temperature achieved within a particular stage of the mechanical refrigerator), information regarding the pressure can be used to modulate the frequency at which the cyclical gas pressure is applied. Since the optimum frequency changes as the mechanical refrigerator cools, it is possible to modulate the frequency so as to approach or obtain the optimum frequency (as a function of temperature) during the cooling cycle.

It is extremely advantageous to be able to use the monitored pressure within one of the gas lines to provide the information upon the cooling cycle since this avoids the needs for direct sensing of the environment within the cooled part or parts of the mechanical refrigerator.

The invention is not limited by the particular coupling element used to connect the mechanical refrigerator to the compressor. Such a coupling element may typically comprise one or more valves. Various types of valves may be used although in the present application a rotary valve is particularly advantageous. The coupling element is typically driven by a motor such as a stepper motor, a 3-phase asynchronous electric motor or linear DC motor driven by a variable DC power supply. The speed of such a motor drive is typically controlled by the control system.

The pressure sensing apparatus may comprise a pressure sensor such as a pressure transducer for monitoring the pressure in at least one of the supply or returning gas lines. The invention can be achieved readily with use of a single sensor in one of these lines although one or more sensors in either or each line are contemplated. It is desirable that the minimum apparatus required for the application in question is provided in the pressure sensing apparatus so as to provide sufficient information regarding the state of the mechanical refrigerator in order to provide sufficient control over the gas supply frequency.

In addition to information regarding the pressure, the system may further comprise temperature sensing apparatus for monitoring a temperature within a cooled region of the mechanical refrigerator. In this case the control system may be adapted to control the frequency of the gas pressure in accordance with the temperature monitored by the temperature sensing apparatus in addition to the pressure sensing apparatus.

Whilst the invention relates primarily to the apparatus for controlling a cryogenic cooling system, it will be appreciated that the invention also may include a cryogenic cooling system comprising such apparatus together with one or each of a compressor in gaseous communication with the supply and return gas lines; and a mechanical refrigerator.

A number of different types of compressor may be used depending upon the application, these including a scroll compressor, rotary screw compressor, rotary vane compressor, rotary lube compressor or a diaphragm compressor. Each of these compressors shares the common features of supply and return lines for the compressor gas. The supply line may be thought of as a relatively high pressure line and the return line may be thought of as a relatively low pressure line for use with the invention.

The invention may be used with a number of different types of mechanical refrigerator, these including a pulse tube refrigerator, a Gifford-McMahon refrigerator and a Stirling refrigerator. Each of these uses a supply gas line and a return gas line in order to enable them to be driven by a compressor. We note here that the apparatus for controlling the cryogenic cooling system may be separate from each of the compressor or mechanical refrigerator with which it is used. It may however be beneficial to include such apparatus as an integral part of the mechanical refrigerator or, possibly, the compressor.

In accordance with a second aspect of the present invention we provide a method of controlling a cryogenic cooling system in which the system comprises a supply gas line and a return gas line for coupling with a compressor, a coupling element in gaseous communication with the supply and return gas lines and adapted in use to supply gas to a mechanical refrigerator, the pressure of said supplied gas being modulated by the coupling element in a cyclical manner; the method comprising monitoring the pressure in at least one of the supply and return gas lines; and, modulating the frequency of the cyclical gas pressure supplied by the coupling element in accordance with the monitored pressure.

Typically therefore the method may be effected by the operation of a suitable control system. The method is typically used by apparatus in accordance with the first aspect of the present invention. It will be understood that a suitable controller may be used to provide the function of the control system and this may include a suitable combination of hardware and software to enable the control system to be calibrated, programmed and operated. Typically, the frequency of modulation of the cyclical gas pressure is arranged to be in accordance with the predetermined relationship. Such a relationship may include a function such as a linear or polynomial function. It may also be provided by a stepwise relationship between the pressure and the frequency provided. It may also be affected by the use of look-up tables rather than direct calculation.

In general, the coupling element is moveable in a rotational manner and in such cases the frequency in question may be effected by moving the coupling element at a corresponding rotational speed. In practice, the provision of a desired frequency may be effected by a desired motor current or speed in situations where the coupling element is driven by a motor.

Preferably the frequency is modulated in accordance with a predetermined relationship. Such a relationship may be embodied in data (for example representing a look up table) or by using a mathematical relationship. In each case the application of the relationship during the method may be achieved by a looped staged process, such as embodied in an algorithm executed by suitable software. The pressure data may be sampled and processed such that the appropriate frequency may be evaluated for each loop of the algorithm, this allowing an immediate "real-time" response to changes in pressure.

It is preferred that the frequency is modulated so as to maintain the monitored pressure within a predetermined pressure range. Such a range may be narrow such as a small percentage of the expected pressure change during the operation of the mechanical refrigerator. It may tend towards a single pressure value in practice. The magnitude of the range may be dependent upon a number of parameters of the apparatus, including the degree of control which can be achieved over the pressure as the mechanical refrigerator cools. The predetermined pressure range is typically set in accordance with a maximum operational pressure of the apparatus. Such a maximum pressure may be determined by the mechanical refrigerator or the compressor for example. The predetermined pressure range may be set as close to the maximum pressure as is practical within safety parameters.

The operational frequency range is also typically controlled so as to provide boundary conditions to the predetermined relationship. For example, if, in accordance with the predetermined relationship, the frequency would, according to the relationship, be below a minimum threshold frequency then the frequency is set to the minimum threshold frequency. This typically occurs in practice where it is found that the optimum frequency for operating the mechanical refrigerator at the base temperature is achieved, according to the relationship, when the mechanical refrigerator is above the base temperature. As an example this may be achieved at a temperature of around 60K even when the base temperature is around 4K.

Similarly, if, in accordance with the predetermined relationship, the frequency would, according to the relationship, be above a maximum threshold frequency then the frequency is set to the maximum threshold frequency.

Preferably the operational frequencies used in the method are in the range 1 to 5 Hz. The operational pressures are typically in the range 1 to 40 MPa.

The invention is not limited to any particular type of coolant gas although it is preferred that the coolant gas is helium. Helium is the preferred coolant for cryogenic applications in which very low temperatures of around 2 to 4 Kelvin are obtainable by the mechanical refrigerator.

Whilst the primary utility of the method is during the cooling cycle of a mechanical refrigerator, it will be appreciated that the process may usually be applied whilst heating up an operational mechanical refrigerator from the base temperature.

BRIEF DESCRIPTION OF THE DRAWINGS

An example of a control system and method according to the present invention is now described with reference to the accompanying drawings in which.

DESCRIPTION OF PREFERRED EXAMPLE

Figure 1:
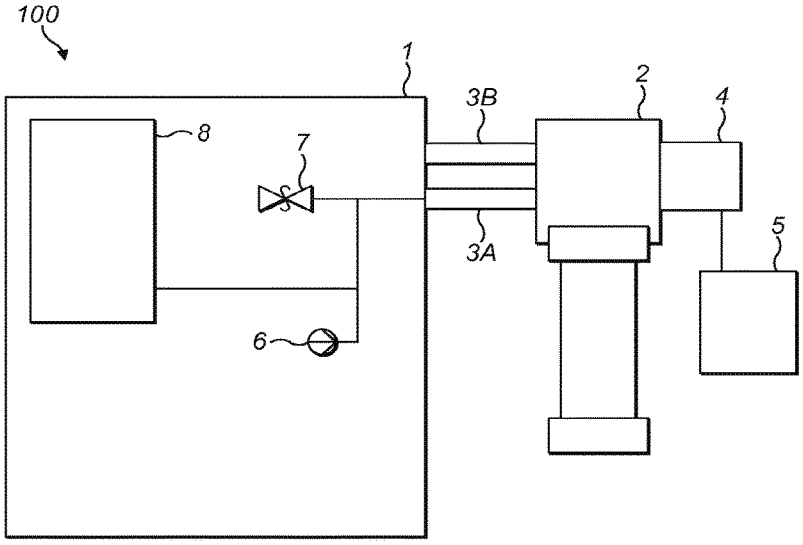
FIG. 1 (PRIOR ART)
FIG. 1 shows a conventional cryogenic cooling system.

In order to provide a full understanding of the invention, we firstly describe a known closed cycle refrigerator (CCR) system in accordance with FIG. 1.

The system 100 comprises a scroll compressor 1 and a pulse tube refrigerator (PTR) 2. Two gas lines 3A and 3B connect the scroll compressor 1 to the pulse tube refrigerator 2. The gas lines 3A and 3B are essentially gas pipes which are capable of withstanding a high pressure. The gas line 3A is a supply line which contains a coolant gas at a high pressure when in use. The line 3B is a return line in the form of a low pressure line. A coupling element in the form of a rotary valve 4 is illustrated as an integral part of the PTR 2. The rotary valve 4 is driven by a motor controller 5 and the operational speed of the motor is fixed to ensure a constant rotational frequency of the rotary valve given by a $F_{optimum}$. This frequency is designed to be the optimum frequency for use of the PTR once at its "cold" or steady-state operational temperature.

Optionally, a pressure sensor 6 may be present within the compressor so as to detect an abnormal pressure within the high pressure line 3A. The scroll compressor 1 is also provided with a bypass system 7 which is caused to operate when a critical value of pressure within the high pressure line is detected. In known systems, the critical pressure within the high pressure line 3A is always reached at the beginning of a cool-down process and remains for a relatively long period of the cool-down process. Depending on the type of mechanical refrigerator, such period can be at least one third and up to one half of the full cooling time required to reach the low temperature regime.

Whilst a critical value of the pressure exists, the bypass 7 remains open and allows coolant gas to pass between the high pressure supply line and the lower pressure return line. In this case the coolant gas is helium and the operation of the bypass 7 ensures that no helium is lost to the external atmosphere. This is important since helium is an expensive gas.

The above described example represents a standard prior art CCR system in which a mechanical refrigerator (cryocooler) is driven by a compressor. The mechanical refrigerator may take various forms including GM coolers, Stirling coolers, pulse tube refrigerators, cold heads and cryopumps. In each of these types of CCR a rotary valve or other coupling element regulates the mass flow of the coolant gas transferred between the compressor and the mechanical refrigerator. In order to maximise the cooling power available at low temperatures, the mechanical refrigerator is designed such that, when in the steady-state or cold condition the PTR (or equivalent) helium mass flow matches the compressor's optimum working point. Therefore in each mechanical refrigerator an optimum frequency value $F_{optimum}$ for the rotary valve or other type of coupling element exists in order to maximum the cooling power.

It is notable however that an important physical property of helium, and indeed of other gases, is that the density of the gas increases as the temperature decreases. In cryogenic systems with mechanical refrigerators, the temperature difference between room temperature and the operational temperature is approximately 290 Kelvin which is a very significant temperature difference. At an operational temperature of around 2 to 4 Kelvin, the density of the helium gas coolant is significantly higher than that at room temperature. With an operational pressure of some bars, the density value of the helium at 4K is more than 100 times higher than its equivalent density at room temperature (300K).

In the conventional CCR system described above, at the beginning of the cool down process, the mass flow of coolant gas delivered by the compressor cannot be fully transferred via the rotary valve to the PTR. This is because the operational frequency of the compressor is too low (a few Hertz). As a result, pressure may build upon the high pressure side of the compressor. Depending upon the initial filling pressure value of the system, a critical limit value may be exceeded. Typically a safety valve is set to operate below a critical value for this pressure and such a safety valve is positioned within the high pressure line. It is known to either vent the excess pressure to the external atmosphere or, as is shown in FIG. 1, to provide the safety valve in the form of a bypass which effectively vents the helium to the low pressure side of the compressor.

The coolant gas pressures in each of the high pressure supply line 3A and low pressure return line 3B are provided by power from a compressor motor 8. The bypass may therefore take the form of an over pressure valve and this is desirable in comparison with a valve which vents the helium to atmosphere since the helium is not lost from the system if a critical value of the pressure is reached. Nevertheless, during the initial cool down, the critical value is always reached at the beginning of the cool down procedure.

Later, as the low temperature steady-state regime is approached, the pressure reduces and the bypass closes. Once the low pressure has reduced to the operational pressure in the steady-state, the frequency of the rotary valve and the pressure which it controls (having a frequency of $F_{optimum}$) attain the optimum for the operational temperature.

Figure 2:
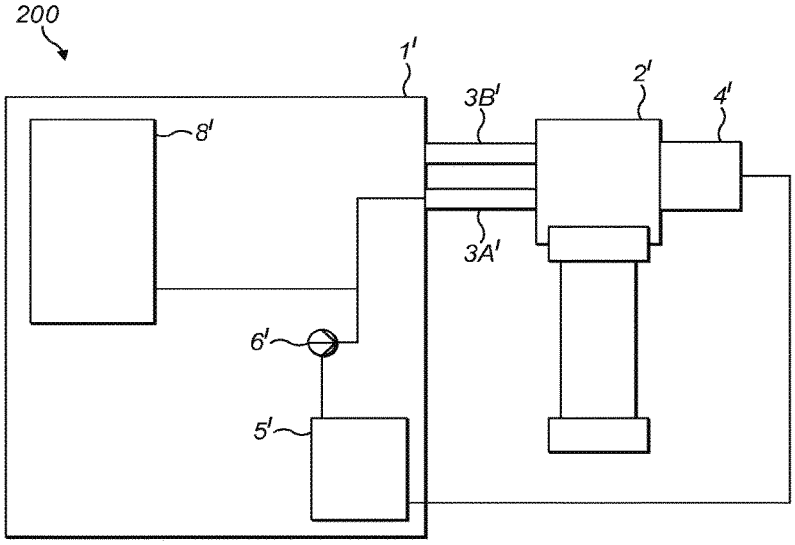
FIG. 2 shows an example cryogenic cooling system according to the invention; and, FIG. 3 shows a flow diagram in accordance with the example of the invention.

An example of a CCR system according to the invention is now described with reference to FIG. 2. In FIG. 2, apparatus having analogous features with that in FIG. 1 is provided with similar primed reference numerals.

In FIG. 2, the CCR system according to the invention is illustrated at 200. A scroll compressor 1' is connected via high (3A') and low (3B') lines to a PTR 2'. A coupling element in the form of a rotary valve 4' again controls the PTR 2'. In this example the rotary valve 4' is operable at a variable frequency F. In this case, the modified motor controller 5' receives a signal from the pressure transducer 6. This transducer is a pressure sensor which provides a monitoring signal which can be related to the pressure magnitude sensed by the transducer. The signal is provided to the motor controller 5'. The motor controller 5' contains a processor and associated programmable memory. The processor samples the signals from the pressure transducer 6' and, using an appropriate algorithm or look-up table, converts these to a suitable control signal which is outputted to the rotary valve 4'. This is illustrated in FIG. 2 by the lines linking the pressure transducer 6' to the motor controller 5', and the motor controller 5' to the rotary valve 4'. The motor controller 5' therefore provides a control mechanism for operating the CCR 200. It will be appreciated that the components shown in FIG. 2 are illustrated schematically and therefore other ordinary equipment which is not specifically shown such as safety valves, oil separates, filters, heat exchangers, sensors and so on, is nevertheless present.

The example apparatus as shown in FIG. 2 therefore has the same benefits as the apparatus in FIG. 1 during steady-state low temperature operation of the mechanical refrigerator in the form of the PTR 2'. However, it also allows improved efficiency to be achieved during the cool down procedure. This is achieved by varying the rotary valve mechanism frequency so as to dynamically accommodate the helium mass flow exchange between the PTR 2' and the compressor 1'. At high temperatures, such as those close to room temperature, the rotary valve 4' is operated with a corresponding frequency regime F that is significantly higher than the optimum design frequency $F_{optimum}$ which is associated with the PTR 2' at its steady-state low temperature. Due to the high frequency regime F, the pressure within the high pressure side of the compressor is reduced in comparison with prior art systems and therefore the mechanical refrigerator is able to operate without losing efficiency at the initial high temperature. Later, when the PTR cools, the frequency regime can be reduced in order to approach and then obtain $F_{optimum}$ as the steady-state temperature is reached.

The overall efficiency of the CCR 200 is therefore considerably improved in comparison with that of known systems such as 100 in FIG. 1. In this particular example, the frequency F is electronically controlled in accordance with a signal from the pressure transducer in accordance with an automatic feedback mechanism which is regulated by the motor controller 5'. It is notable that no temperature sensors or, in this particular example, that no more than one pressure transducer 6' is used. The key parameter is the maximum pressure allowed in the system, because this is typically the design limitation of the compressor and this governs the possible cooling efficiency of the mechanical refrigerator.

Thus the efficiency of the PTR 2' is maximised. It will be appreciated that an algorithm to optimise the frequency F plus the function of the pressure experienced may be derived by calculation or by experimental measurements. A further variable for consideration in deriving for such an algorithm (or equivalent) is a consideration to ensure that overall vibrations are reduced.

The practical benefit of the example apparatus is that the CCR system 200 reaches the low temperature regime more quickly than the equivalent CCR 100 shown in FIG. 1. The available cooling power at high temperatures is also considerably enhanced such that an overall improvement of the key parameters of the system by at least 35% is observed.

Figure 3:
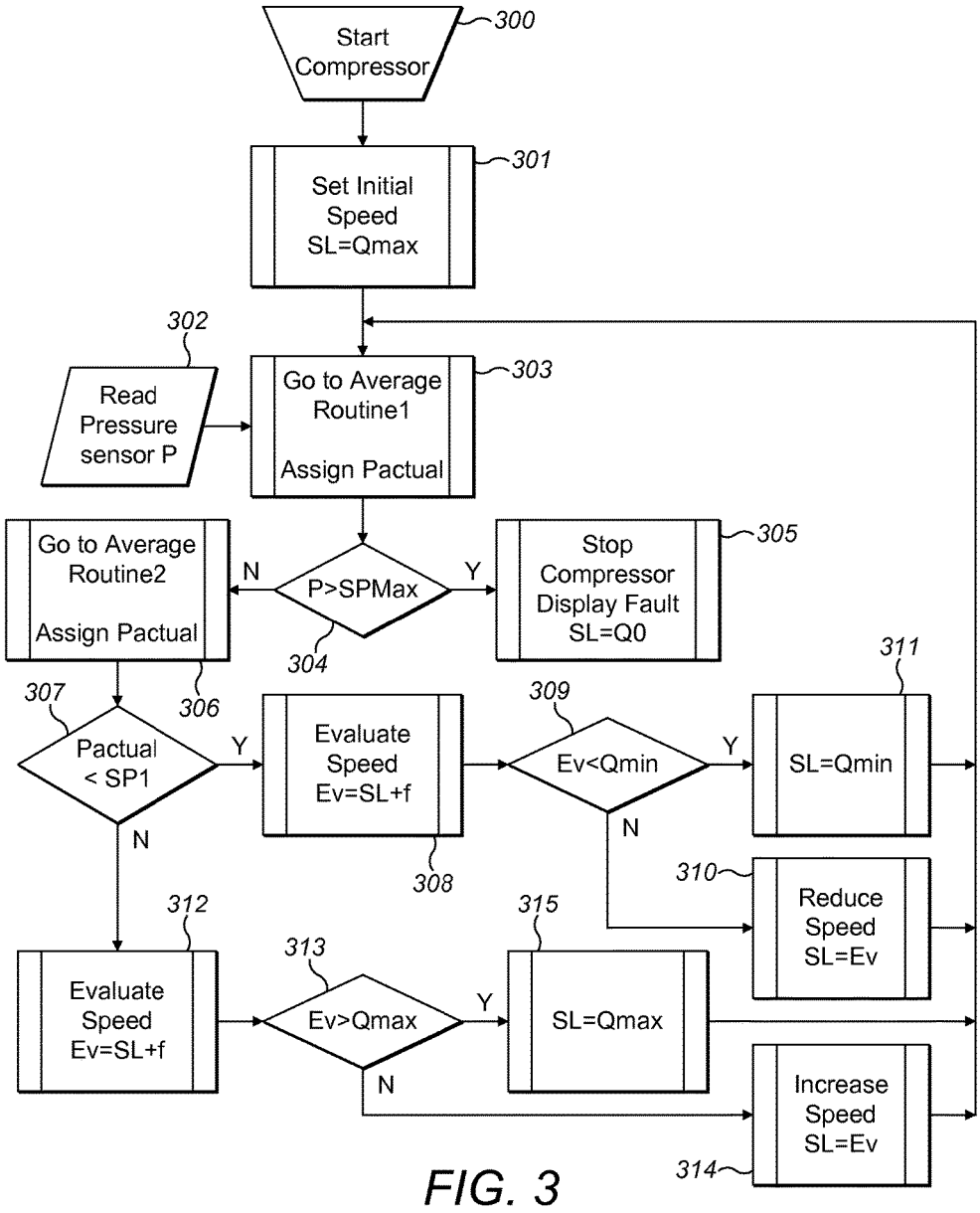

Referring now to FIG. 3, the operation of the system as shown in FIG. 2 is described in more detail. At step 300 the compressor 1' is started and the compressor motor 8' is initiated. At step 301 the motor controller 5' rotates the rotary valve 4' at a speed ("SL") which is a maximum for the PTR 2' in question. This value is denoted "Qmax" in FIG. 3. At step 302 the signal from the pressure transducer 6' is sampled and averaged by an algorithm denoted "Routine1", the sampling being at a rate of a few milliseconds. At step 303 a first pressure reading is evaluated by converting an averaged pressure signal over a number of counts into a pressure reading, denoted "Pactual". At step 304 Pactual is compared with a predetermined set point value (denoted "SPMax"). If the pressure Pactual is greater than SPmax (which might be typically 410 psi or 2.83 MPa) then the compressor is automatically stopped at step 305 and a fault code is displayed. Such failure typically occurs when the high pressure line is not connected to the rotary valve 4' or is blocked.

If however the pressure is lower than the set point pressure of 410 psi (2.83 MPa) then at step 306 a second algorithm ("Routine2") is used in which the motor controller 5' begins taking monitored pressure readings at a predetermined sampling rate. Routine2 converts a rolling average of pressure values from the pressure transducer 6' and assigns the evaluated value to Pactual.

At step 307 Pactual is compared with a set point pressure SP1. SP1 is a pressure value slightly less than the maximum pressure (SPmax) allowed by the compressor design (SP1 is for example 400 psi, 2.76 MPa). It is desirable to operate the PTR, when possible, at the highest safe pressure which can be thought of as SP1, this allowing the maximum cooling power of the PTR 2'. As the PTR 2' cools the speed of the rotary valve 4' required to maintain the high pressure close to SP1 gradually decreases. For this reason a gradual slowing of the rotary valve 4' is desired. This is achieved by monitoring the pressure Pactual.

At step 308, which occurs if the average pressure Pactual is less than the set point pressure (SP1), then a reduction in speed of the rotary valve 4' is desirable. At step 308 an evaluated speed Ev is calculated. This is calculated as the current speed (SL) modified by an amount "f" representing a decremental change in the speed. This evaluated speed is compared with a speed Qmin at step 309. Qmin is the optimal speed in the "cold condition" for the PTR 2' (that is the speed used at the base temperature). If the evaluated speed Ev is not less than Qmin then the reduction in speed is assigned as the new speed SL at step 310. Having reduced the speed the algorithm returns to step 303 and repeats.

If the evaluated speed Ev at step 308 is less then Qmin, then at step 311, the speed SL is set to Qmin and the algorithm loops back to step 303.

The other alternative at step 307 is that the pressure Pactual is not less than SP1. In this case it is desirable to increase the speed of the rotary valve 4'. A similar calculation is then performed at step 312 to that performed at step 308, namely, calculating the evaluated speed, Ev. Here the evaluated speed is then compared with a speed Qmax at step 313. Qmax is the maximum speed of operation of the rotary valve 4' which in turn is set by the maximum operational speed of the PTR 2'.

At step 314, if the evaluated speed Ev is not greater than Qmax then an increase of the speed (SL) to Ev is effected. The algorithm then loops back to step 303.

If the evaluated speed Ev is greater than Qmax, than a step 315, the speed SL is set at Qmax and the algorithm again loops back to step 303.

This process is repeated throughout the operation of the PTR 2' and in particular during the cooling cycle.

The global effect of this is that the actual pressure Pactual is maintained closer to SP1 by reducing the speed until Qmin is reached. It is the nature of the operation of the system the Qmin is reached before the PTR 2' reaches the base temperature. Once Qmin is actually reached then in practice Pactual reduces due to the further cooling but the speed SL remains unchanged at the Qmin value.

Whilst the focus of the present example is in the cooling cycle of a closed cycle refrigerator such as the PTR 2', it is also notable that such a process as described above also works during a warming procedure from the base temperature.

There are a number of different practical means by which the algorithm which governs the process of FIG. 3 may be implemented. In FIG. 3, values for "f" may be calculated by the equation: f=c (Pactual−SP1) where c is a constant. This ensures that the magnitude of change in the speed which may be effected during each process loop is proportional to the difference between the actual pressuce (Pactual) and the desired pressure (SP1).

It will be appreciated that the illustrative example of FIG. 3 can be easily effected via look-up tables. A more advanced system having effectively a continuum of temperature-pressure regimes can of course be contemplated and effected either via a corresponding number of table entries in a look-up table or via a calculation according to a linear or polynomial approximation for example. This may include the use of additional considerations for optimising the performance of the system, such as in reducing vibrations.

The invention claimed is:

1. A method of controlling a cool-down process of a cryogenic cooling system, the cryogenic cooling system comprising a supply gas line and a return gas line for coupling with a compressor, a rotary valve in gaseous communication with the supply and return gas lines that supplies gas to a pulse tube refrigerator and cyclically modulates the pressure of the supplied gas so that the pressure varies at a given frequency, and a motor that drives the rotary valve, the method comprising:

storing predetermined relationships between each of a plurality of pulse tube refrigerator temperatures and an optimum frequency for maximizing the cooling power of the pulse tube refrigerator, obtaining feedback indicative of the temperature of the pulse tube refrigerator by monitoring the pressure in at least one of the supply and return gas lines;

identifying the optimum frequency for maximizing the cooling power of the pulse tube refrigerator based on the feedback indicative of the temperature of the pulse tube refrigerator and the predetermined relationship; and controlling a speed of the motor, while reducing the temperature of the pulse tube refrigerator towards an operational base temperature, to modulate the frequency of the cyclical gas pressure supplied by the rotary valve to approach or obtain the identified optimum frequency.

2. The method according to claim 1, wherein the rotary valve is moveable in a rotational manner and wherein the frequency of the cyclical gas pressure supplied by the rotary valve is effected by moving the rotary valve at a corresponding rotational speed.

3. The method according to claim 1, wherein the optimum frequencies identified by the predetermined relationships reduce vibrations of the cryogenic cooling system while maximizing the cooling power of the pulse tube refrigerator.

4. The method according to claim 3, wherein if, in accordance with the predetermined relationship, the frequency of the cyclical gas pressure supplied by the rotary valve would be below a minimum threshold frequency then the frequency of the cyclical gas pressure supplied by the rotary valve is set to the minimum threshold frequency.

5. The method according to claim 3, wherein if, in accordance with the predetermined relationship, the frequency of the cyclical gas pressure supplied by the rotary valve would be above a maximum threshold frequency then the frequency of the cyclical gas pressure supplied by the rotary valve is set to the maximum threshold frequency.

6. The method according to claim 1, wherein the frequency of the cyclical gas pressure supplied by the rotary valve is modulated to maintain the monitored pressure within a predetermined pressure range.

7. The method according to claim 6, wherein the predetermined pressure range is set in accordance with a maximum operational pressure of the cryogenic cooling system.

8. The method according to claim 1, wherein the frequency of the cyclical gas pressure supplied by the rotary valve is in the range of 1 to 5Hz.

9. The method according to claim 1, wherein the monitored pressure is in the range of 1 to 40 MPa.

10. The method according to claim 1, wherein the gas is helium.

11. The method according to claim 1, wherein the predetermined relationships between each of the plurality of pulse tube refrigerator temperatures and an optimum frequency for maximizing the cooling power of the pulse tube refrigerator is a mathematical relationship.

12. The method according to claim 1, wherein the predetermined relationships between each of the plurality of pulse tube refrigerator temperatures and an optimum frequency for maximizing the cooling power of the pulse tube refrigerator is stored in a look-up table.

* * * * *